United States Patent [19]

Budington et al.

[11] 3,944,072

[45] Mar. 16, 1976

[54] OCTAGONAL DISPENSER CARTON FOR BAND SAW COILS

[75] Inventors: Richard V. Budington, Somers, Conn.; Michael F. Bradley, West Springfield, Mass.

[73] Assignee: Longview Fibre Company, Longview, Wash.

[22] Filed: June 2, 1975

[21] Appl. No.: 582,754

[52] U.S. Cl. ..... 206/395; 206/409; 221/70; 229/41 C

[51] Int. Cl.[2] ..... B65D 85/672; B65H 5/28

[58] Field of Search..... 229/41 C; 225/53, 90; 206/409, 395, 391, 389; 221/70

[56] References Cited

UNITED STATES PATENTS

| | | | |
|---|---|---|---|
| 2,471,173 | 5/1949 | Taylor | 229/41 C |
| 2,674,372 | 4/1954 | Schweich | 229/41 C |
| 3,115,243 | 12/1963 | Nash | 206/409 |
| 3,149,719 | 9/1964 | Thompson et al. | 206/395 |
| 3,260,360 | 7/1966 | Davis | 206/409 |

*Primary Examiner*—George E. Lowrance
*Assistant Examiner*—Allan N. Shoap
*Attorney, Agent, or Firm*—Chapin, Neal and Dempsey

[57] ABSTRACT

An octagonal dispenser carton for packaging coils of band saw blade stock in bulk lengths is formed from a flat corrugated cardboard blank having a main octagonal center section, rectangular side wall flap sections foldably joined to each edge thereof, and polygonal end wall flaps extending from said side wall sections, said end wall flaps combining when in folded position to securely hold the side walls and without reinforcement to contain a coil of blade stock.

8 Claims, 9 Drawing Figures

OCTAGONAL DISPENSER CARTON FOR BAND SAW COILS

BACKGROUND

This invention relates to a folded carton and package for bulk length coils of saw blade stock for band saw use and the like. The carton is specifically of the "dispenser" type from which a toothed blade may be unwound for cutting into any length which might be required, such as for blade replacement purposes.

More particularly, the carton comprises a casing of regular octagon shape formed by folding a single flat blank of corrugated cardboard or similar paper board material around a coil of blade stock, the toothed side of the coil being covered by a flat disc of similar paper board material. The coil is thus rotatably contained in the casing for unwinding and a "dispensing" action by pulling the free end from the carton. The free end passes through an exit opening in a side wall and when the desired length is withdrawn and cut, the coil is rotatively readjusted as by rewinding to an extent needed to conveniently hold the recently cut end at the exit opening and readily accessible for another "dispensing" operation.

Heretofore, in packaging coils of band saw blade stock, insofar as is known, the trade practice has been largely confined to square containers in which triangular corner blocks are mounted so as to give stability as well as provide an octagonal interior shape to the side wall which is necessary for satisfactory coil rotation. For light reels or smaller coils injection molded plastic containers having an annular cavity for rotatively holding a coil and a tangentially directed exit slot for the blade end are also well known to the trade. From the standpoint of economical and efficient packaging operations, such prior equipment has various drawbacks. Briefly, space and inventory problems can arise where the containers are preformed as in the case of the molded plastic cases above referred to. Further, problems of time and labor costs inevitably are involved where foldable carton blanks are to be fitted with corner blocks at or immediately in advance of a carton loading operation. The present invention is designed to minimize such inventory and storage problems and at the same time simplify the packaging process so as to reduce costs insofar as possible for packaging this type of article.

In the packaging of coiled band saw stock it is to be noted that bulk lengths of 250 feet or more involve a weight on the order of 50 or 80 lbs. or better. More importantly the closely wound coil is made up for carton packaging has many of the characteristics of a huge watch spring. Unless adequately restrained it will spring apart in total disarray. Thus pressures on a carton are exerted in many ways as blade stock is unreeled and for this reason such measures as the reinforcement at the corners of conventional square cartons by triangular blocks, which also permit satisfactory rotation, has been considered necessary. Thus, while folding cartons of octagonal form have been found suitable for various other products, it has not heretofore been proposed as feasible for band saw blade coils because of the unique and somewhat "balky" nature of the particular product. The main object of the present invention as previously indicated is to provide a flat carton blank of a particular shape readily foldable into an octaganol package in order to securely contain a band saw coil for dispensing purposes and eliminate the need for added reinforcement measures than are provided for by the folded blank itself.

SUMMARY

In practicing the present invention a flat unitary blank of foldable corrugated cardboard material is formed with a main center section of regular octagon shape, rectangular side wall flap sections at each edge thereof and polygonal end wall flaps extending from the side walls.

The flaps of alternate side walls are each a mirror image of the adjacent half portion of the octagonal main section and fold over in facing pairs to provide two plies of the folded end wall. The remaining intermediate flaps have inner edge portions diverging outwardly from the end edges of each of the connecting side wall sections, intermediate parallel portions which abut the adjacent flap edges, and converging outer portions. The latter flaps fold over as quarter portions of a third ply underneath the first two plies, the divergent inner edge portions thereof being caught by the fold line connection of the outer ply flaps at each side and thus helping to maintain the side walls of the inner ply flaps in place against any pressures from the coil contained in the carton.

The toothed side of a coil of blade stock is covered by a circular disc of cardboard material when folding the same into the carton and the coil is thus rotatable in the carton for the dispensing operation by passage of the free end through a slotted opening in one of the side walls and unreeling a desired length of blade from the coil.

FIGURES

DESCRIPTION

Figure 1:
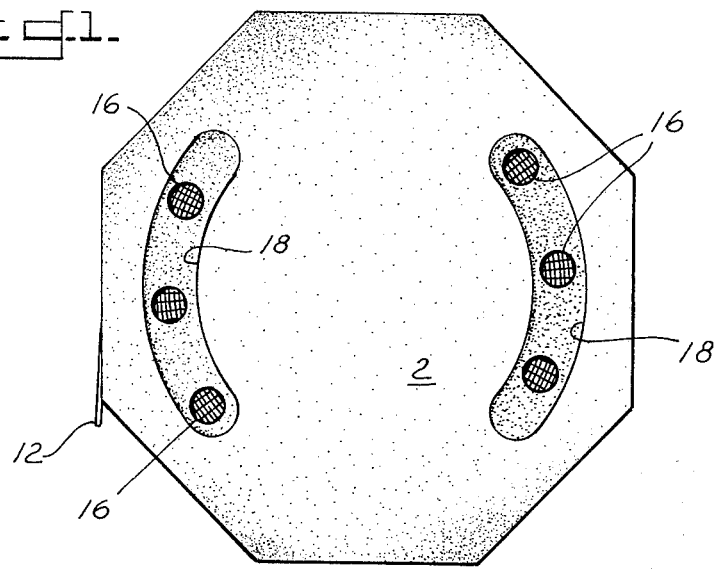
FIG. 1 is a plan view of one face of an octagonal carton embodying the invention.
Figure 2:
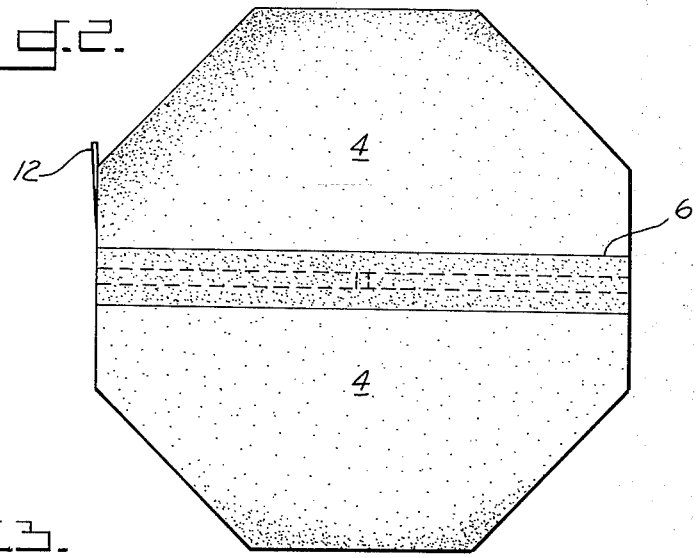
FIG. 2 is a plan view of the opposite face of the carton of FIG. 1.

The carton of the present invention, as shown by the front and rear faces or end walls in FIGS. 1 and 2, is in the form of a regular octagon. Folded from a unitary flat blank as will be later described in detail, the front end wall is formed by a single center panel section 2 (FIG. 1), while the rear end wall is a composite or multi-ply arrangement having an outer panel face (FIG. 2) provided by a pair of folded over closure flaps 4. Flaps 4 are half sections of an outer ply of the end wall and are secured together in suitable manner at their mating edges as by an adhesive sealing tape at 6.

Figure 3:
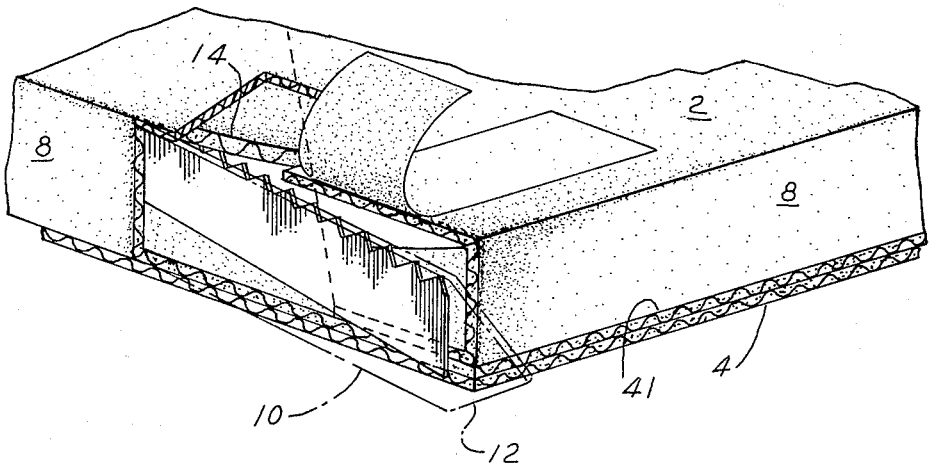
FIG. 3 is a fragmentary perspective view on an enlarged scale showing provision for a side wall opening to withdraw and dispense blade stock from the carton.

The side walls of the folded carton are rectangular panel flap sections 8 integrally extending and folded at right angles to the edges of the single panel 2 (FIG. 3). Sets of end wall closure flaps foldably extend from the walls 8 and provide a three-ply construction. The outer ply comprises flaps 4 as noted. The next ply comprises a pair of flaps 40 (see FIGS. 4–6) similar to flaps 4 and folded in crosswise underlying relation. The third and inner ply comprises a set of four flaps, as at 41 (FIGS. 4, 5), these flaps being folded from the edges of the remaining side walls between the flaps 4 and 40 of the alternate side walls 8.

Within the cavity of the closed carton (FIGS. 1–3) a coiled bulk length of band saw blade stock is enclosed so that any desired length can be stripped or dispensed therefrom as for saw blade replacement purposes. As best seen in FIG. 3 the free end of the coil may be withdrawn through a slotted opening provided in one of the side walls 8. As shown a tear strip portion 10 (FIGS. 4, 5) is formed with a tabbed end 12 for grasping and rupturing the strip and passing the blade through the opening.

Figure 4:
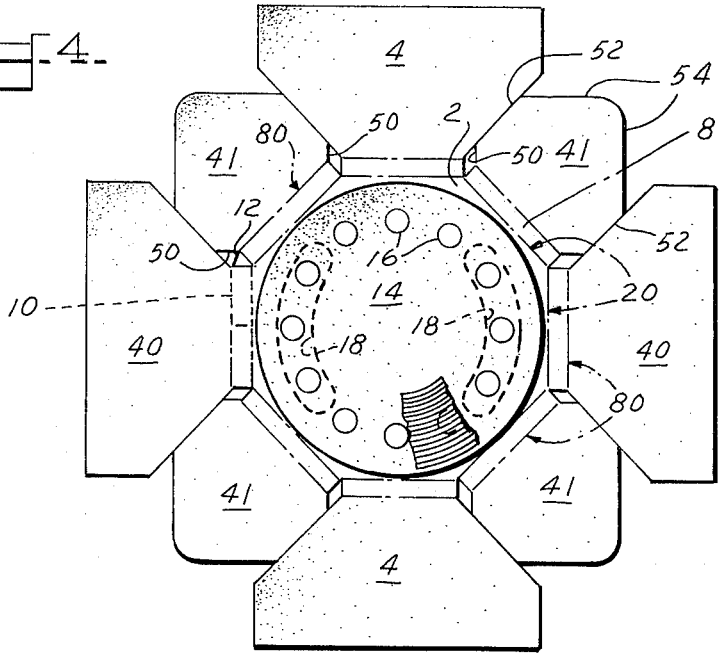
FIG. 4 is a plan view of a flat carton blank from which the carton package of FIGS. 1–3 may be formed, a disc for rotatably supporting the coil blade being shown in position thereon.
Figure 5:
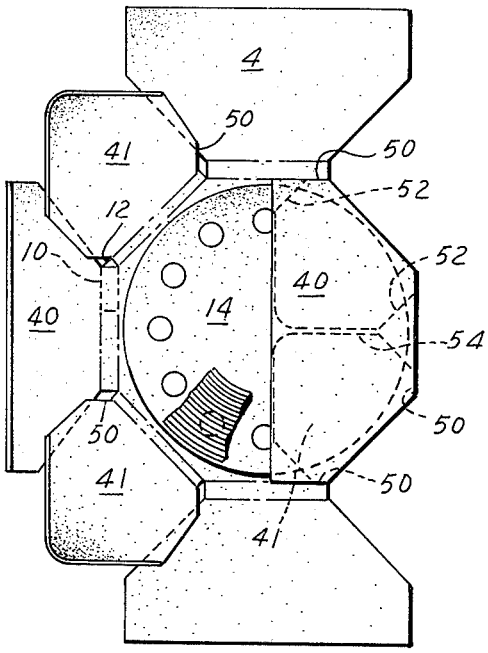
FIG. 5 is a view similar to FIG. 4 of a partly folded blank to illustrate initial steps in forming a carton.

The coil is mounted in the carton with a rotatable disc member as at 14 lying against the inner surface of the front wall 2 and slightly less than tangent to the side walls 8 (see FIG. 4). Mounted with the blade teeth against the disc the blade can be unwound from the coil as the coil is rotated by withdrawal of its free end through the opening provided by the tear strip 10. As also indicated in FIGS. 1, 4 and 5, the disc 14 is provided with a concentric ring of openings as at 16 accessible through arcuate slots 18 cut in the end wall 2. The openings 16 are for hand manipulating the disc 14 for rotation of the coil either for the purpose of moving the coil for assistance in unwinding the free end, or once a desired length has been cut off to enable the rewinding of the cut end back into the carton.

Figure 6:
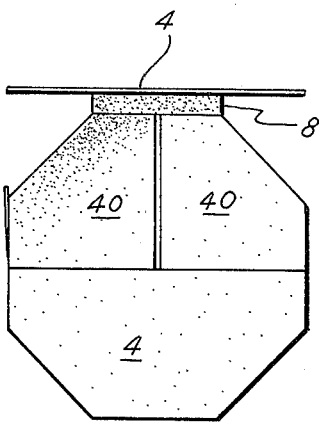
FIG. 6 is a similar view indicating the sequence of steps to complete the carton of FIGS. 1 and 2.

The ease with which the carton can be loaded and closed will be appreciated from FIGS. 4–6. FIG. 4 shows the flat unitary blank from which the carton casing is formed. Laid in place thereon is the disc 14 on which a coil rests. As seen in the flat (FIG. 4) the single ply end wall panel or main section 2 has the rectangular side wall sections 8 extending from each edge thereof. The inner edges of walls 8 are creased fold lines shown in phantom as at 20. The creased parallel fold lines as at 80 indicate the outer edges of the walls 8 from which the respective end closure flaps 4, 40 and 41 extend.

As above noted the inner ply of the folded end wall is formed by inwardly turning flaps 41. This can be conveniently done (see FIGS. 4 and 5) by upwardly bending flaps 41 on opposite sides of each flap 40 so that an upward and inward swinging movement of the latter will quickly carry the smaller flaps 41 into flattened relation over the coil. As shown by FIG. 5 at the right the flaps 41 are in the fully folded positional relation and anchored by the overlying flap 40. At the left it will be noted that in the slightly raised position the edges of flap 40 overlap the adjacent edges of flaps 41. Thus by manually swinging over flap 40 alone, a rapid closing action of all three flaps is accomplished. With flaps 40 in place, outer flaps 4 (FIG. 6) may be turned inwardly and folded in crosswise fashion over flaps 41 to complete the folding and the package may then be sealed as by taping the mating edges (FIG. 2).

As noted in the drawings, each pair of flaps 4 and 40 extends from diametrically opposite and parallel edges of the main section 2. In outline each is a mirror image of that half of the main section 2 adjacent thereto.

Flaps 41 are formed and extend from the sides 8 at 90° positions about the main section 2. As shown each is formed with inner edge portions 50 divergently directed from the ends of outer fold line 80 of wall 8 and at an angle of 135° to line 80. Thus when folded over (see FIG. 5) such inner edge portions are securely caught in the fold between the adjacent wall 8 and its attached flap 4 or 40.

Parallel intermediate edge portions at 52 abut the parallel edges of the adjacent flaps 4 and 40 and outer edge portions as at 54 converge in a rounded 90° corner. Flaps 41, as noted, are quarter sections providing the inner ply of the folded three-ply wall, each flap of this inner ply being interlocked against shifting outwardly by securing the corner edges at 50. This prevents coil pressures tending to break out of any of the connecting side walls 8 under hard usage. As for walls 8 of flaps 40 and 4 the greater expanse of these flaps in covering one half of an end wall is sufficient to resist any coil pressures.

Figure 7:
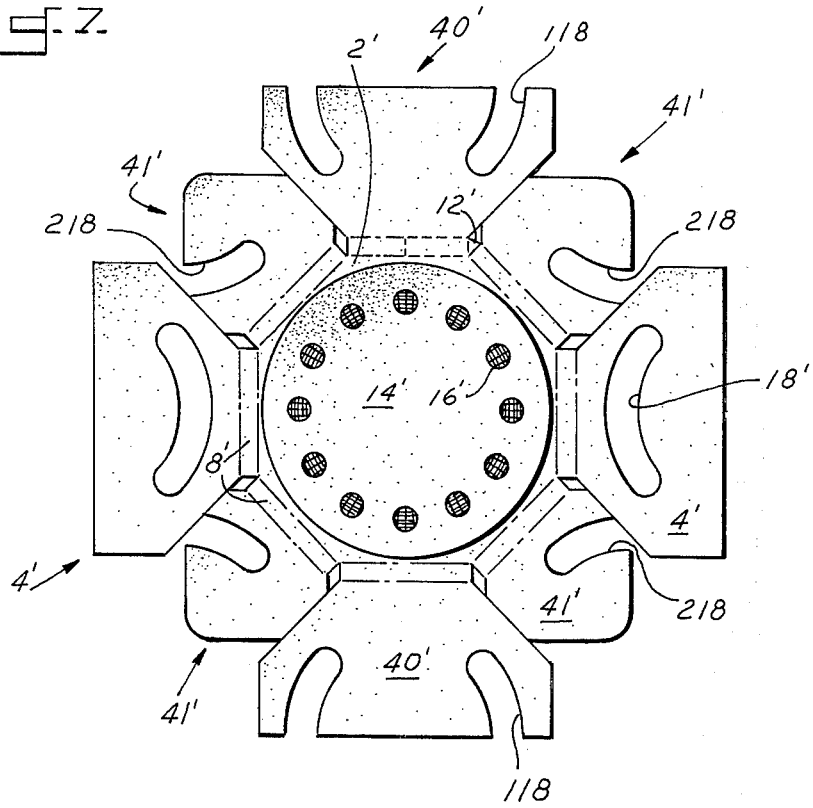
FIG. 7 is a plan view similar to FIG. 4 of a modification of the carton blank.
Figure 8:
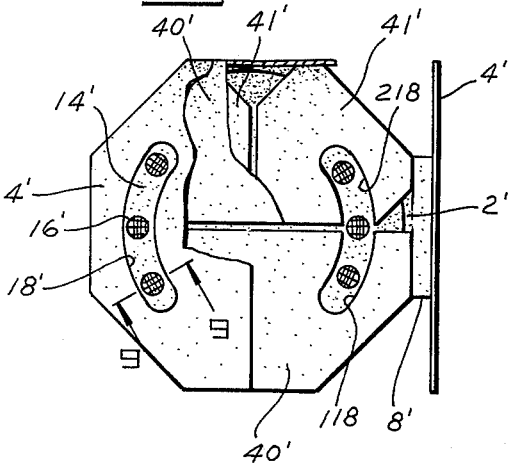
FIG. 8 is a similar plan view indicating a partial folding of the FIG. 7 blank.
Figure 9:
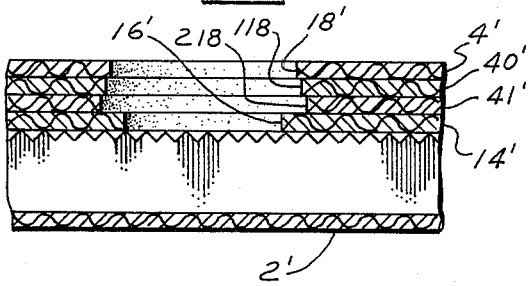
FIG. 9 is a sectional view as on line 9—9 to show the details of the finished carton package of FIGS. 7 and 8.

In FIGS. 7–9 a modified blank and carton is shown. This construction differs from that of FIGS. 1—6 in the provision for the tooth covering disc to rest against the three-ply end wall. As will be apparent this necessitates providing arcuate slots in the various flaps for manipulating the relative positions of the disc and coils in the carton. The desirability of either position of the disc depends largely on the preference of those handling a particular packaging operation.

As will be appreciated band saw blade stock when being made up into coils is wound under considerable tension. As previously mentioned the result may be likened to a huge watch spring which can be extremely dangerous, if not properly restrained. As will be appreciated the teeth will normally face upwardly during the winding as on a table-top spindle fixture. Accordingly, after suitably tying down the ends of a coil a disc such as the perforated disc 14 (FIG. 4) will be placed on top of the bundle and in loading the package of FIGS. 1–6 the coil and disc are turned upside down onto the center section 4 and the flaps folded as previously described.

The step of manually lifting and turning a formed coil and disc upside down for proper seating on the center section 2 of the blank in FIG. 4 may be eliminated, if preferred, by using a modified form of blank as shown by FIG. 7. Here, the smooth side of the coil can be deposited on the center section 2′ of the modified blank by a simple sliding action on the platform surface on which a coil is formed (the disc remaining uppermost). In FIG. 7 a disc 14′ having perforations 16′ identical with the disc seen in FIG. 4, is lodged against the upwardly facing toothed side of the coil and in a finished carton (FIG. 9) lies against the folded three-ply end wall as will be apparent.

The various parts of the FIG. 7 blank corresponding to the same portions of the blank of FIG. 4 are indicated by primed numerals. The arcuate opening for access to the perforated disc 14′ is formed by registering portions of slots cut in the folded end flaps. It will be apparent particularly from FIG. 8 that the end closure flaps when folded in correct sequence will present in the finished carton opposed arcuate slots 18′ in the outer ply of flaps 4′ comparable to the closed end slots 18 of FIG. 1. The underlying flaps 40′ of the intermediate ply and flaps 41′ of the inner ply are provided with mating open-ended slotted portions in the edges thereof for registering in underlying relation with the closed slots 18' of flaps 4'. Also, as will be noted from FIG. 9 the underlying portions are preferably progressively of greater width and thus provide for any dimensional tolerances resulting from variations in the manual work of folding the end flap assemblies. The slotted portions of the intermediate ply flaps 40' are indicated at 118 and of the inner ply flaps 41' at 218. It will be clear from considering FIG. 7 and FIG. 8 that the flaps 41' at each side of the flaps 40' are first folded under the latter and over disc 14' and thereafter the flaps 4' are folded over for bringing the slots into registration and sealing the carton.

What is claimed is:

1. A flat carton blank foldable into an octagonal dispenser casing for packaging a bulk length coil of band saw stock and the like, said blank comprising a center section having fold lines defining the edges of an end wall panel in the shape of a regular octagon, rectangular side wall panel sections extending from said edges, and polygonal end wall flaps having fold line connections at the outer edges of side wall sections, alternate flaps around the blank each having an outer edge parallel to the side wall fold line connection thereof and in overall outline being substantially a mirror image of the adjacent half of said octagonal center panel, each of the remaining flaps having side edges provided with inner portions divergently directed and angled at approximately 135° from the side wall fold line connections thereof, generally parallel intermediate edge portions angled at about 135° from said inner portions and extending along the edges of adjacent alternate flaps, and converging outer edge portions angled at approximately 90° to each other from said intermediate portions, each said remaining flap being foldable into underlying relation to said alternate flaps adjacent thereto to form the inner ply of a multi-ply folded end wall opposite said center panel with said diverging inner edge portions being held against radial outward movement in the fold line connections of said adjacent flaps and side walls.

2. A flat blank as in claim 1, in which slotted portions are provided at diametrically opposite locations in said blank to form access openings through a folded carton end wall and thereby permit rotative adjustment of a coil contained in said carton

3. A flat blank as in claim 2, in which the slotted portions are arcuate and located in said center panel section.

4. A flat blank as in claim 2, in which the slotted portions are arcuate and located in said end wall flaps in matching areas thereof for registration in the folded condition of the blank.

5. An octagonal container of foldable corrugated cardboard sheet material for packaging coils of spring tensioned band saw blade stock and the like and dispensing lengths therefrom said carton comprising an integrally formed end and side wall casing structure having a regular octagonal first end wall panel, rectangular side wall panels folded from the edges of said first panel, and an octagonal second end wall panel of multi-ply formation opposite said first end wall having closure flaps folded from the side panel edges, each flap of one set of alternate side wall panels being a mirror image of that half portion of the first end wall adjacent its connecting side wall, and the two diametrically positioned pairs of flaps thus formed providing an outer and an intermediate ply of said second end wall panel, each flap of the other set of alternate side wall panels being substantially a quarter section of an innermost ply and each being held in anchored relation by the flaps folded over from the adjacent side walls, a circular disc rotatably engaging the inner face of one of said end wall panels adapted to receive the toothed side of a coiled length of saw blade stock, and means for securing the flaps of the outer ply together, one of said side wall panels having means to provide an opening for passing the free end of a coiled blade to the exterior.

6. An octagonal carton as in claim 5, in which said circular disc is rotatably disposed against the inner face of the first end wall panel and is provided with a plurality of spaced openings arranged concentrically of said disc, and said first end wall panel has diametrically opposed arcuately slotted portions through which the openings of said disc are accessible for rotatively manipulating said disc and the position of a coil mounted thereon in said casing structure.

7. An octagonal carton as in claim 5, in which said circular disc is rotatably disposed against the innermost ply of the second end wall panel and is provided with a plurality of spaced openings arranged concentrically of said disc, and said flaps of the multi-ply second end wall panel are provided with registering slotted portions forming diametrically opposed arcuate openings through which said openings of the disc are accessible for rotatively manipulating said disc and the position of a coil mounted thereon in said casing structure.

8. An octagonal container as in claim 7, in which the slotted portions in the outermost ply of said second end wall panel are closed end slots in each half of said ply, and the slotted portions of the other plies in registration therewith are formed by matched half-slots in abutting edges of the flaps of said other plies underlying said closed slots.

* * * * *